US005302783A

United States Patent [19]

Sadr et al.

[11] Patent Number: 5,302,783

[45] Date of Patent: Apr. 12, 1994

[54] RESONATOR

[75] Inventors: Changize Sadr, Toronto; Douglas J. Georgas, Blenheim, both of Canada

[73] Assignee: ABC Group, Rexdale, Canada

[21] Appl. No.: 994,348

[22] Filed: Dec. 21, 1992

[51] Int. Cl.[5] ..... F01N 7/18

[52] U.S. Cl. ..... 181/243; 181/246; 181/250; 181/276

[58] Field of Search ..... 181/227, 228, 229, 230, 181/233, 243, 250, 251, 266, 269, 273, 275, 276, 282, 246

[56] References Cited

U.S. PATENT DOCUMENTS

| | | | |
|---|---|---|---|
| 1,547,601 | 7/1925 | Maxim | 181/250 |
| 4,244,442 | 1/1981 | Scarton et al. | 181/230 |
| 4,874,062 | 10/1989 | Yanagida et al. | 181/250 |

*Primary Examiner*—Michael L. Gellner

*Assistant Examiner*—Khamh Dang

*Attorney, Agent, or Firm*—George A. Seaby

[57] ABSTRACT

In general, sound resonators or mufflers are bulky self-contained metal bodies, which are expensive to produce and to install in an engine intake or exhaust system. A relatively simple substitute, which can be tailor made to attenuate sound at various frequencies include two arcuate casing sections which are interconnected along one side edge by a hinge, so that the sections can be wrapped around an engine air intake tube, a latch on the other side edges of the sections for securing the sections together to form a sleeve around and coaxial with the tube, an inlet nozzle on the interior of each section for extending into the tube, and partitions extending between the inner and outer surfaces of each section for defining elongated, tortuous, sound attenuating passages.

8 Claims, 4 Drawing Sheets

RESONATOR

BACKGROUND OF THE INVENTION

1. Field of the Invention

This invention relates to a resonator, and in particular to a resonator for use on an air inlet tube attached to an internal combustion engine.

2. Discussion of the Prior Art

Air is introduced into an automotive engine for creating an air/gasoline mixture which fuels the engine. Typically, the air passes through an air filter, an inlet tube, a throttle body or carburetor and an intake or inlet manifold to the cylinders of the engine. Sound generated in the cylinders, i.e. engine noise travels back through the manifold and the inlet tube.

Many attempts have been made to reduce or attenuate engine noise. Typical devices for sound attenuation are described in for example Canadian Patent No. 703,518, issued to E. Ludlow et al on Feb. 9, 1965, and U.S. Pat. No. 3,111,191, issued to J. Bachert on Nov. 19, 1963; U.S. Pat. No. 3,388,769, issued to R. J. Martoia on Jun. 18, 1968; U.S. Pat. No. 3,612,268, issued to O. E. Rieder on Dec. 1, 1969; U.S. Pat. No. 3,966,015, issued to W. A. Bychinsky on Jun. 29, 1976; U.S. Pat. No. 4,124,092, issued to S. Kajiya et al on Nov. 7, 1978; U.S. Pat. No. 4,132,286, issued to H. Hasui et al on Jan. 2, 1979; U.S. Pat. No. 4,164,266, issued to L. Collin et al on Aug. 14, 1979; U.S. Pat. No. 4,165,798, issued to G. Martinez on Aug. 28, 1979; U.S Pat. No. 4,172,508, issued to L. C. Moss et al on Oct. 30, 1979; U.S. Pat. No. 4,281,742, issued to A. Scheuermann et al on Aug. 4, 1981; U.S. Pat. No. 4,415,059, issued to Y. Hayashi on Nov. 15, 1983; U.S. Pat. No. 4,418,790, issued to R. E. Agnew on Dec. 6, 1983; U.S. Pat. No. 4,538,701, issued to D. C. Lowery et al on Sep. 3, 1985; U.S. Pat. No. 4,574,914, issued to R. T. Flugger on Mar. 11, 1986; U.S. Pat. No. 4,623,035, issued to K. Schad et al on Nov. 18, 1986; U.S. Pat. No. 4,848,513, issued to G. Csaszar on Jul. 18, 1989; U.S. Pat. No. 4,874,062, issued to K. Yanagida et al on Oct. 17, 1989 and U.S. Pat. No. 4,890,691, issued to C. Ching-ho on Jan. 2, 1990.

It is well established that the geometry of a resonator determines the sound attenuating efficiency of the device. In this connection, reference is made to the introductory portion of the Kajiya et al U.S. Pat. No. 4,124,092 which succinctly sets out the physics of the situation. It is readily apparent that the altering of resonator dimensions affects noise attenuation. The mufflers described in the above listed patents, and for that matter mufflers in general are discrete devices which must be installed in an inlet or exhaust system by interrupting the system. Usually the muffler forms part of the system, and is connected to tubes or pipes forming other parts of the system by clamps or welding. Thus, the installation or removal of a muffler is a somewhat difficult, time consuming and often expensive job. Moreover, the structures used to achieve the desired attenuation are often complicated and consequently expensive to produce.

GENERAL DESCRIPTION OF THE INVENTION

An object of the present invention is to solve the above mentioned problems by providing a relatively simple, easily installed, resonator, which can be inserted into existing inlet or exhaust systems.

Another object of the invention is to provide a resonator which can readily be mass produced by blow molding at relatively little expense.

Accordingly, the present invention relates to a sound resonator device for use on a sound transmitting tube connected to an engine comprising elongated casing means, said casing means including two elongated, hollow sections of arcuate cross section; hinge means interconnecting one side edge of one section to one side edge of the other section, whereby said sections can be wrapped around the sound transmitting tube to define a hollow sleeve with the hinge means extending longitudinally thereof; partition means in each said section dividing the interior thereof into at least one elongated, tortuous passage; and inlet means in each said section for connecting the interior of said tube to the passage in said section, whereby sound is attenuated runing movement along said tortuous passage.

The invention will be described in greater detail with reference to the accompanying drawings, which illustrate a preferred embodiment of the invention, and wherein:

GENERAL DESCRIPTION OF THE DRAWINGS

DESCRIPTION OF THE PREFERRED EMBODIMENT

Figure 2:
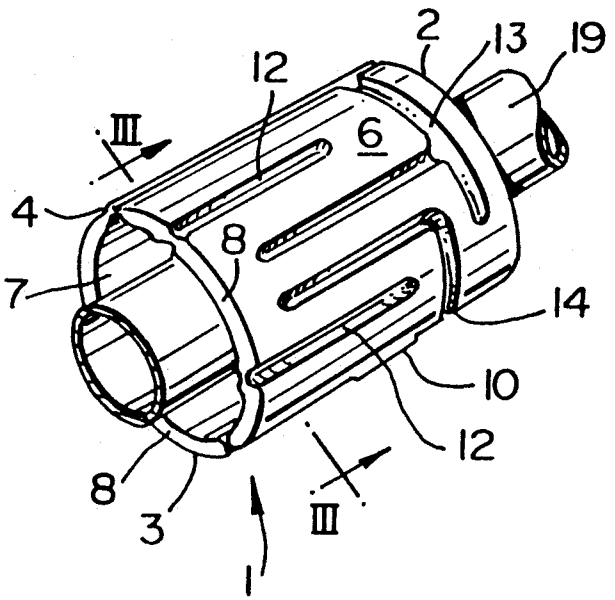
FIG. 2 is a schematic, isometric view of the resonator of FIG. 1 in the closed position around a duct.
Figure 3:
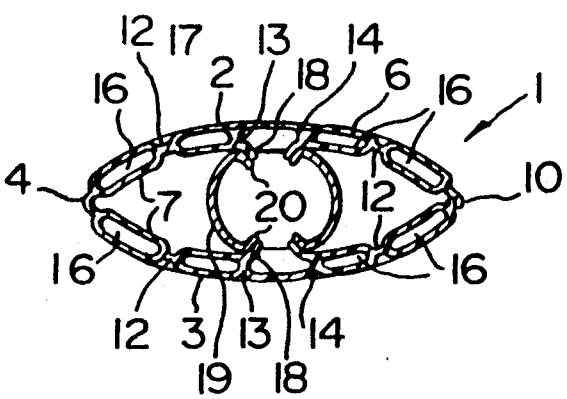
FIG. 3 is a cross section taken generally along line III—III of FIG. 2.
Figure 1:
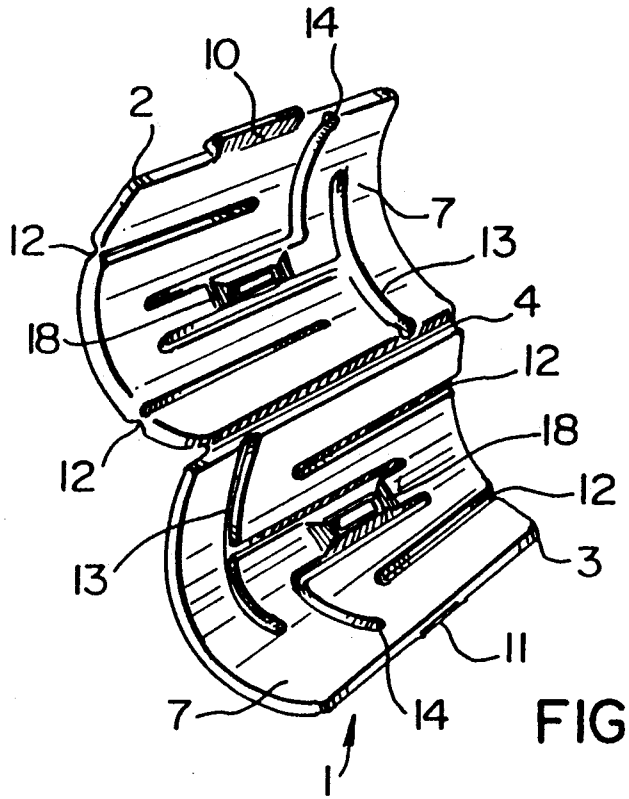
FIG. 1 is a schematic, isometric view of a resonator in accordance with the present invention in the open position.

With reference to FIGS. 1 to 3, a resonator in accordance with the present invention which is generally indicated at 1 includes an elongated casing defined by a pair of arcuate, hollow sections 2 and 3. The sections 2 and 3 are pivotally interconnected along one side edge by a hinge 4. The hinge 4 is merely a web of material integral with the sections 2 and 3.

Each section 2 and 3 is concavo-convex in cross section, and includes an outer wall 6, an inner wall 7 and end walls 8. The side edges of the walls 6 and 7 are pinched together. Whenfolded together (FIGS. 2 and 3), the sections 2 and 3 define an oval cross section tube or casing. The free side edges of the casing are interconnected by a latch defined by a lug 10 on one section 2 and a detent 11 in the other panel 3. The walls 6 and 7 of each section 2 and 3 are joined by a pair of longitudinally extending straight partitions 12, a T-shaped partition 13 and an L-shaped partition 14. The partitions 12, 13 and 14 divide the interior of the sections 2 and 3 into elongated tortuous passages 16 (FIG. 3) of varying lengths. An inlet nozzle 18 extends outwardly from the center of each inner wall 8 of each section 2 and 3. When the sections are wrapped around a pipe or tube 19 (FIGS. 2 and 3), the nozzles 18 project inwardly through an opening 20 in the pipe or tube.

The material used in the resonator is polyethylene, polypropylene reinforced or rubber modified thermoplastic polyolefin, an engineering material, e.g. a polyamide, ABS (acrylobutadiene styrene or polyphenyl oxide). Rubber modified thermoplastic polyolefin is preferred because of its flexibility and ease of modification to obtain a high specific gravity, e.g. 1.6 to 1.8. Higher mass is desired for sound reduction. An example of a suitable rubber modified thermoplastic polyolefin is Salflex 355EX-S (trademark) available from Salflex Polymers Ltd., Concord, Ontario.

Figure 4:
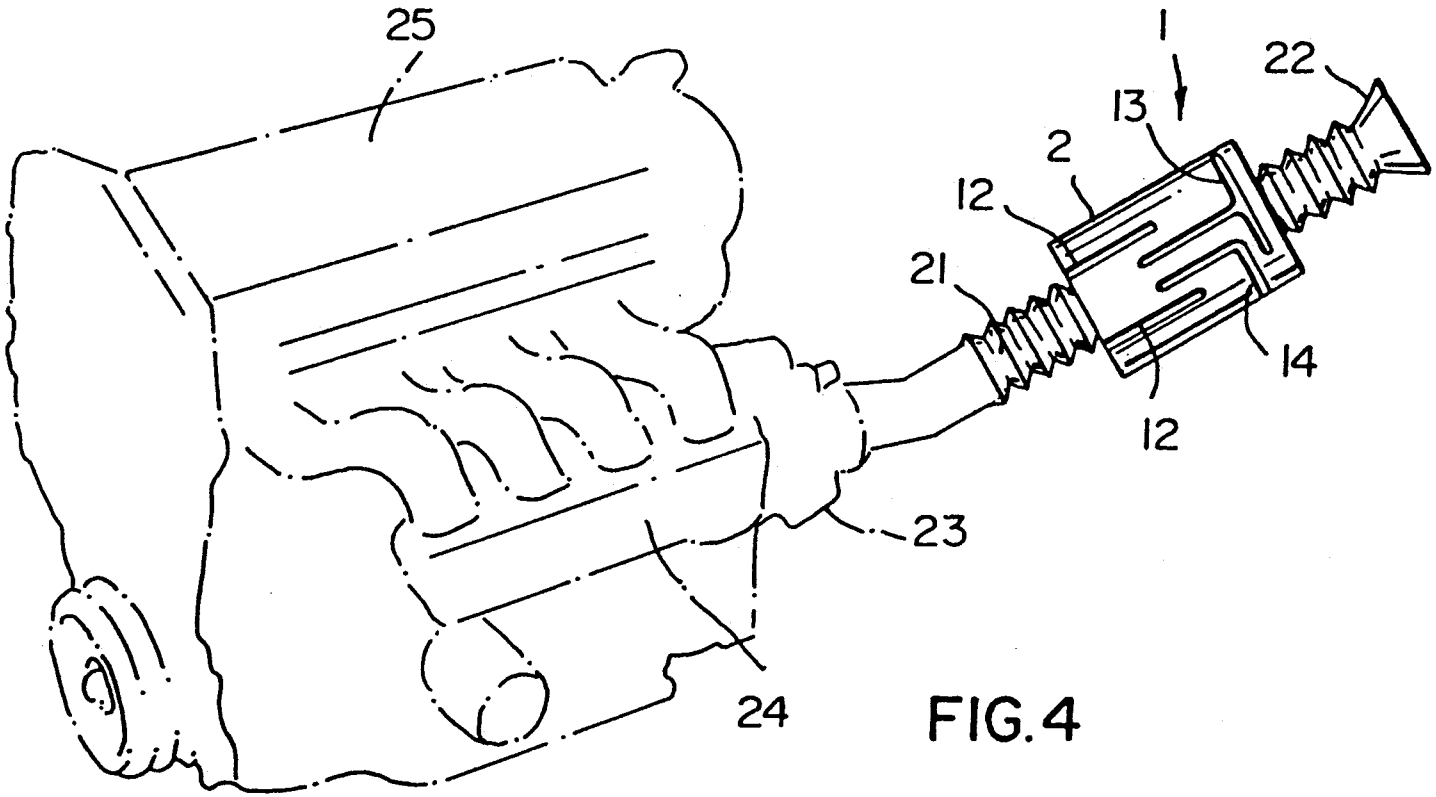
FIG. 4 is a schematic, isometric view of an engine and resonator in accordance with the present invention.
Figure 5:
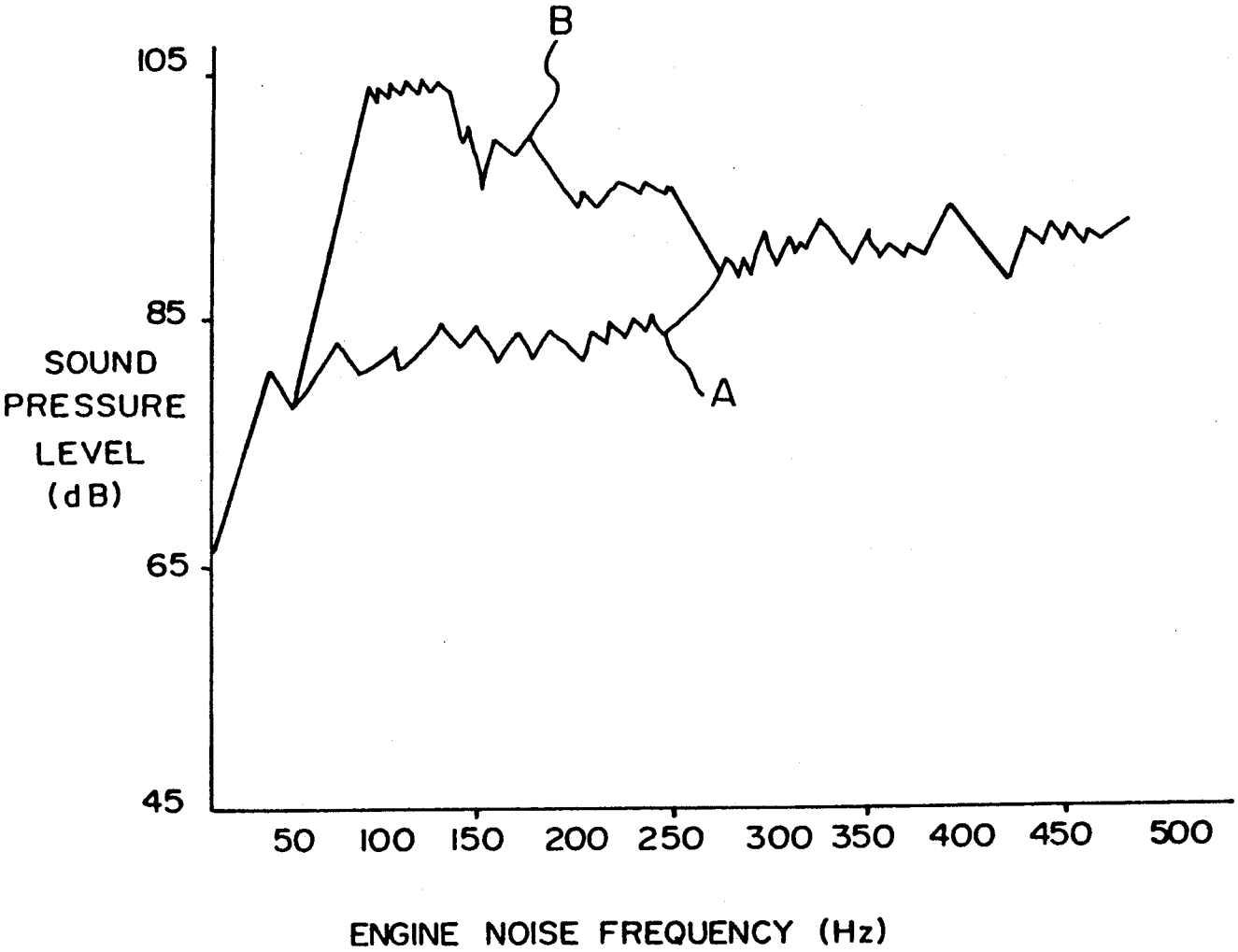
FIG. 5 is a schematic graph of sound pressure level versus engine noise frequency for a vehicle with and without resonator of FIGS. 1 to 3.
Figure 6:
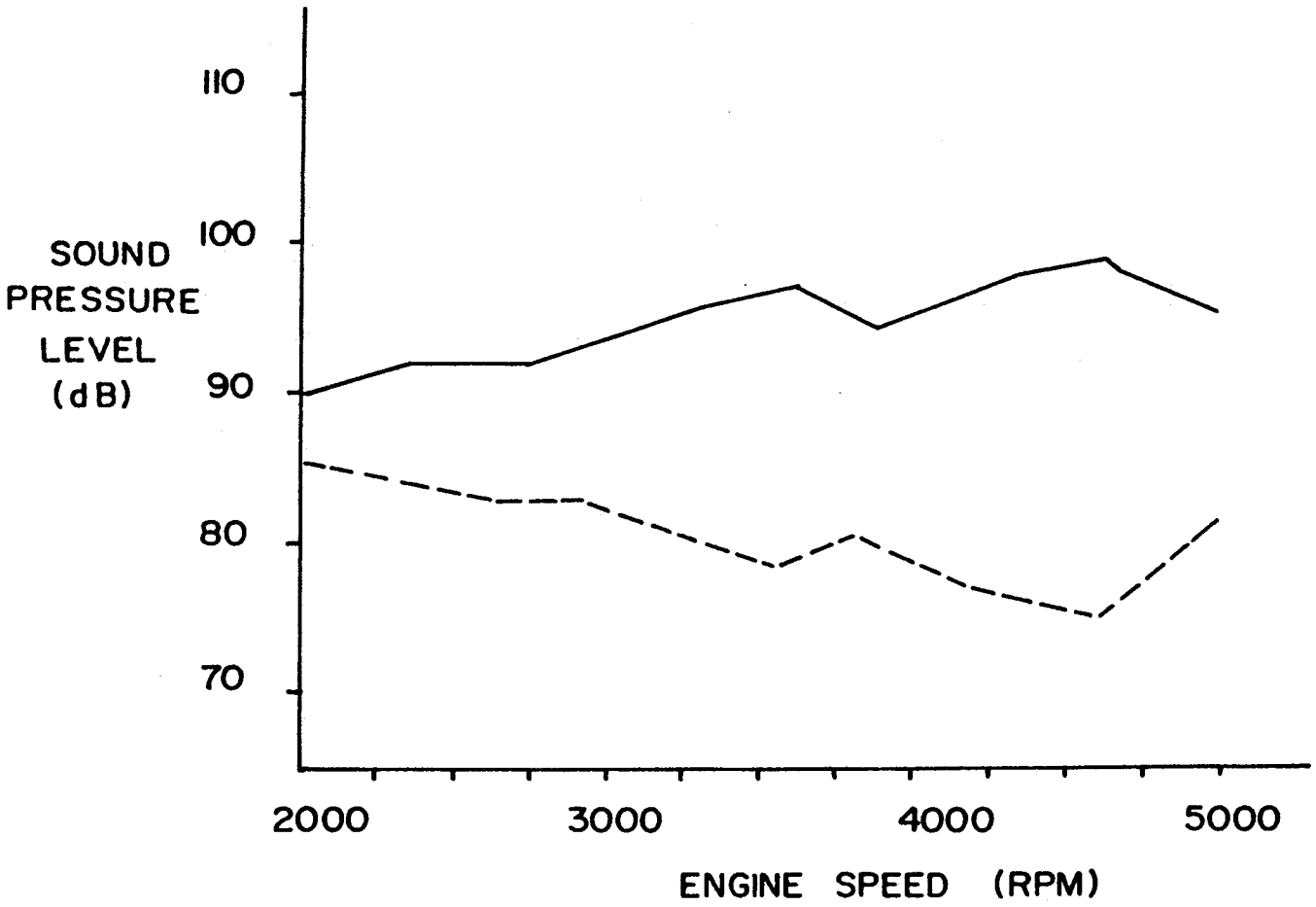
FIG. 6 is a schematic graph of sound pressure level versus engine speed for a vehicle with and without the resonator of FIGS. 1 to 3.

As shown in FIGS. 2 and 4, in use the resonator 1 is mounted on a pipe or tube—in this case a flexible air intake tube 21, which carries air from its inlet end 22 through a throttle 23 and an intake manifold 24 to an automobile engine 25. The geometry of the passages 16 can readily be changed to attenuate noises at different frequencies. The graph of FIG. 5 is a simplistic representation of the results of tests using the resonator 1 of FIGS. 1 to 3. It will be noted that with no resonator 1 on the intake tube the noise level (plot A) at certain frequencies is substantially higher than the noise level (plot B) when the resonator 1 is installed on the intake or inlet tube 21. FIG. 6 is a graph of expected overall sound pressure level in decibels versus engine speed for a vehicle without the resonator 1 (the solid upper line on the graph) and for a vehicle using the resonator 1 (the broken lower line). It has been found that a dramatic decrease in the sound pressure level can be realized by using a resonator 1 of the type described herein.

It will be appreciated that the interior of the sections 2 and 3 can be in fluid communication with each other in the area of the hinge 4. Thus, in its simplest form, the device of the present invention includes one inlet nozzle 18 and a single elongated tortuous passage 16. Moreover, the geometry and the number of sections can be changed, provided that the sections can be wrapped around a tube or pipe to surround the latter.

We claim:

1. A sound resonator device for use on a cylindrical sound transmitting tube connected to an engine comprising elongated casing means, said casing means including two elongated, hollow sections of arcuate cross section, each said section being concavo-convex, and including parallel outer and inner walls; hinge means interconnecting first side edges of said sections whereby said sections can be wrapped around the cylindrical sound transmitting tube; partition means in each said section dividing the interior thereof into one elongated, tortuous passage; an inlet nozzle extending outwardly from the center of said inner wall of each said section for connecting the interior of said tube to the passage in said casing means, whereby sound is attenuated during movement along said tortuous passage; and latch means on the free side edge of at least one said section for engaging the free side edge of the other said section for securing the sections together around a tube.

2. A sound resonator device for use on a sound transmitting tube connected to an engine comprising elongated casing means, said casing means including two elongated, hollow sections of arcuate cross section; hinge means interconnecting one side edge of one section to one side edge of the other section, whereby said sections can be wrapped around the sound transmitting tube to define a hollow sleeve with the hinge means extending longitudinally thereof; partition means in each said section dividing the interior thereof into at least one elongated, tortuous passage; and inlet means in each said section for connecting the interior of said tube to the passage in said section, whereby sound is attenuated during movement along said tortuous passage.

3. A device according to claim 2, wherein each said section is concavo-convex in cross section, and includes parallel inner and outer walls, said inlet nozzle entering outwardly from the inner wall of said section, whereby the nozzle extends radially inwardly of the casing means through the sound transmitting tube during use.

4. A device according to claim 3, wherein said inlet nozzle is located in the centre of said concave inner wall, said partition means defining passages in each longitudinal direction of said casing means.

5. A device according to claim 3 including latch means on the other side edge of at least one said section for engaging the other side edge of the other said section for securing the sections together around the sound transmitting tube.

6. A device according to claim 2, wherein said body means, partition means and inlet means are integral with each other, and are formed of a plastic.

7. A device according to claim 6, wherein the plastic is selected from the group consisting of polyethylene, polypropylene, reinforced or rubber modified thermoplastic polyolefin, a polyamide, acrylobutadiene stryene or polyphenyl oxide.

8. A device according to claim 7, wherein said plastic has a specific gravity of 1.6 to 1.8.

* * * * *